US006749328B1

(12) United States Patent
Killen

(10) Patent No.: US 6,749,328 B1
(45) Date of Patent: Jun. 15, 2004

(54) WHEELBARROW WITH MIXING ASSEMBLY

(76) Inventor: Robert Killen, 1121 Mission St., South Pasadena, CA (US) 91030

( * ) Notice: Subject to any disclaimer, the term of this patent is extended or adjusted under 35 U.S.C. 154(b) by 0 days.

(21) Appl. No.: 10/280,720

(22) Filed: Oct. 25, 2002

(51) Int. Cl.[7] ..... B28C 5/16

(52) U.S. Cl. ..... 366/48; 366/65; 366/67; 366/325.4

(58) Field of Search ..... 366/45–48, 64–67, 366/314, 327.1, 327.3, 325.4, 606

(56) References Cited

U.S. PATENT DOCUMENTS

| | | | | | |
|---|---|---|---|---|---|
| 1,604,616 | A | * | 10/1926 | Strietmann | 366/46 |
| 1,854,732 | A | * | 4/1932 | Beran | 366/304 |
| 2,744,735 | A | * | 5/1956 | Selvage | 366/46 |
| 3,820,763 | A | | 6/1974 | Questi et al. | |
| 4,060,225 | A | | 11/1977 | Cunningham | |
| 4,063,716 | A | | 12/1977 | Aitken, Jr. | |
| 4,091,457 | A | * | 5/1978 | Slywka | 366/304 |
| 5,419,633 | A | * | 5/1995 | Lorenzetti et al. | 366/40 |

FOREIGN PATENT DOCUMENTS

| | | | |
|---|---|---|---|
| GB | 2108002 A | * | 5/1983 |
| JP | 62-176530 | * | 8/1987 |
| JP | 63-9510 | * | 1/1988 |
| JP | 63-175632 | * | 7/1988 |
| WO | 01/54876 A1 | * | 8/2001 |

* cited by examiner

*Primary Examiner*—Charles E. Cooley
(74) *Attorney, Agent, or Firm*—Goldstein Law Offices, P.C.

(57) ABSTRACT

A wheelbarrow with a mixing assembly for mixing aggregate building products. The wheelbarrow has a base assembly and an open hopper mounted on the base assembly. The mixing assembly has a mixing blade positioned within the hopper, and a motor. A motor housing is positioned under the hopper, within the base assembly, and houses the motor. A shaft extends from the mixing blade through the bottom surface of the hopper into the motor housing. The shaft connects the mixing blade with the motor, and allows for rotational movement of the blade to effect cutting grooves into the aggregate substances within the hopper when the motor is activated.

8 Claims, 2 Drawing Sheets

WHEELBARROW WITH MIXING ASSEMBLY

BACKGROUND OF THE INVENTION

The invention relates to a wheelbarrow with a mixing assembly for mixing aggregate building products. In particular, the invention is a wheelbarrow having a hopper for holding a quantity of cement, concrete, or mortar mix, and water. A mixing blade is located within the hopper and is operable by a motor for combining the mixture held within the hopper.

When working with cement or mortar, an aggregate, generally comprising sand, rocks, and cement, is combined with water to form concrete. Since a wheelbarrow is often a convenient device to get the mixed concrete to where it is needed, a wheelbarrow is often used to not only transport the raw materials, but mix and pour the concrete. Typically the elements are placed in the hopper of a wheelbarrow and combined with a shovel. Besides being a taxing task, it is difficult to thoroughly mix the elements, thus often leaving an amount of unmixed powder and sand.

Thus, there exists a need for a motorized mixing assembly that is incorporated into a wheelbarrow. The mixing assembly would allow for a thorough and effortless combination of the cement or mortar with the added water. The mixing assembly would cut grooves into the mixture contained within the hopper, thereby facilitating the infiltration of water through the mixture.

U.S. Pat. No. 4,060,225 to Cunningham discloses a wheelbarrow with a removable mixer, wherein the mixing blade is situated within the container. However, the mixing blade has two axially spaced arms which extend out of the container, thus creating a potential hazard for those working with the wheelbarrow and those in the near vicinity.

U.S. Pat. No. 4,063,716 to Aitken Jr. discloses a portable mixing device that is secured to the edges of a wheelbarrow.

U.S. Pat. No. 3,820,763 to Questi Sr. et al. discloses a portable cement mixer for mixing cement within a wheelbarrow. However, the mixer is detachably mounted to a post fixed to the ground and has a swingable arm for engagement with the contents of the wheelbarrow.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved wheelbarrow with mixing assembly. As such, the general purpose of the present invention, which will be described subsequently in greater detail, is to provide a new and improved wheelbarrow with mixing assembly which has all the advantages of the prior art and none of the disadvantages.

To attain this, the present invention essentially comprises a wheelbarrow with a mixing assembly for mixing aggregate building products. The wheelbarrow has a base assembly and an open hopper mounted on the base assembly. The mixing assembly has a mixing blade positioned within the hopper, and a motor. A motor housing is positioned under the hopper, within the base assembly, and houses the motor. A shaft extends from the mixing blade through the bottom surface of the hopper into the motor housing. The shaft connects the mixing blade with the motor, and allows for rotational movement of the blade to effect cutting grooves into the aggregate substances within the hopper when the motor is activated.

It is an object of the invention to produce a wheelbarrow with a mixing assembly incorporated thereto to allow a user to cut grooves into the aggregate substances in order to combine the ingredients. Accordingly, the mixing assembly is driven by a motor and allows the concrete to be combined without requiring manual effort.

It is a further object of the invention to provide a wheelbarrow with a mixing assembly that thoroughly mixes the concrete and prevents waste. Accordingly, the mixing blade has a plurality of vertical tines, including an outermost scraping tine which follows the contour of the hopper to ensure that unmixed concrete does not remain at the edges of the hopper, nor create a wedge between the outermost tine and the inside wall of the hopper.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
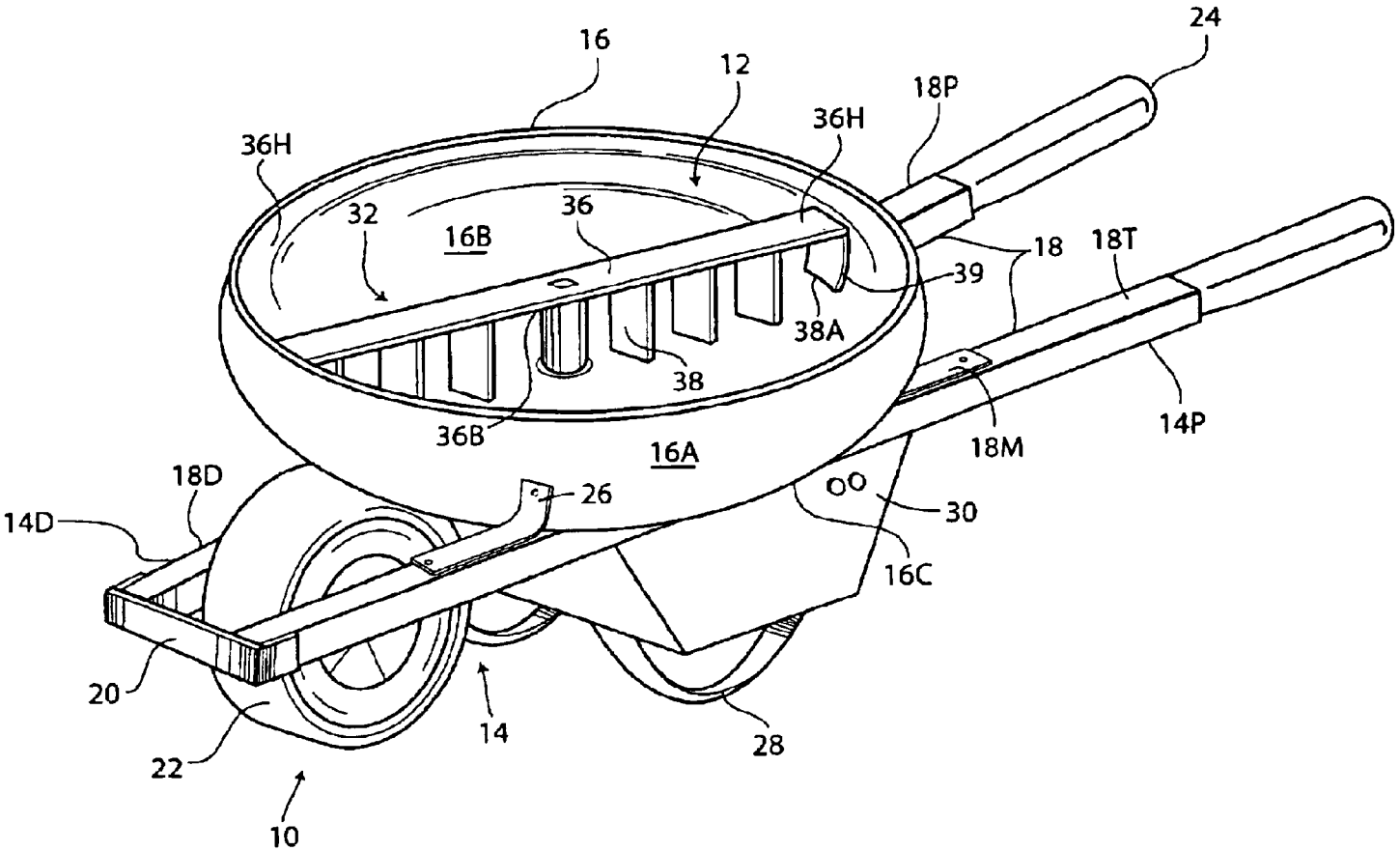
FIG. 1 is a perspective view of a wheelbarrow with a mixing assembly in place therein.

10 wheelbarrow
12 mixing assembly
14 wheelbarrow base assembly
14P base assembly proximal end
14D base assembly distal end
16 wheelbarrow open hopper
16A open hopper outer surface
16B open hopper inner surface
16C open hopper bottom surface
18 base assembly support
18P support proximal end
18D support distal end
18M support middle portion
18T support top surface
20C-shaped bracket
22 wheel
24 handle
26 brace
28 U-shaped leg
30 motor housing
32 mixing blade
34 motor
36 horizontal arm
36B horizontal arm bottom surface
36H horizontal arm half
38 tines
38A outermost scraping tine
39 outermost scraping tine leading edge
40 shaft
42 chain

DETAILED DESCRIPTION OF THE PREFERRED EMBODIMENTS

FIG. 1 illustrates a wheelbarrow 10 with a mixing assembly 12 incorporated therein for combining aggregate building products, such as for combining a sand mixture with water and cement to produce ready to use concrete.

The wheelbarrow 10 generally comprises a base assembly 14 and an open hopper 16 mounted on said base assembly 14. The base assembly 14 has a proximal end 14P, a distal end 14D, and a pair of elongated horizontal supports 18 extending between the proximal and distal ends 14P, 14D. The horizontal supports 18 each have a top surface 18T, a proximal end 18P, a distal end 18D, and a middle portion 18M extending therebetween, wherein handles 24 extend outward from each support proximal end 18P. A C-shaped bracket 20 extends vertically between the distal ends 18D of the supports 18, thereby connecting said supports 18, and spacing them apart at the distal end 18D. A front wheel 22 is mounted between the support distal ends 18D and allows for movement of the wheelbarrow 10. A U-shaped leg 28 extends vertically downward from each support 18 at the middle portions 18M, said legs 28 maintaining the wheelbarrow's stability when stationary. In order to move the wheelbarrow 10, a user grips the two handles 24 and lifts upward. This movement raises the legs 28 off of the ground and places most of the weight of the wheelbarrow 10 on the front wheel 22 with a portion supported at the handles 24 by the user. The user may then push the wheelbarrow 10 by the handles 24.

A motor housing 30 is positioned under the middle portion 18M of the base assembly horizontal supports 18, between the legs 28 and directly below the hopper 16. The housing 30 protects the motor 34 from damage, as well as contact with water or other fluids.

The hopper 16 has an outer surface 16A, an inner surface 16B, and a bottom surface 16C. The bottom surface 16C rests upon the top surface 18T of the wheelbarrow supports 18. A plurality of braces 26 serve to secure the hopper 16 to the base assembly 14, said braces 26 extending from the support top surfaces 18T to the hopper outer surface 16A near both the proximal 18P and distal 18D portions of the supports 18.

The mixing assembly 12 comprises a mixing blade 32 and a motor 34, wherein the mixing blade 32 is positioned within the hopper 16 for horizontal rotation within said hopper 16 about a vertical axis and the motor 34 is positioned within the motor housing 30, directly below the hopper 16 for effecting rotation of the mixing blade 32. The mixing blade 32 has a horizontal arm 36 having a bottom surface 36B, two halves 36H, and a plurality of tines 38 extending substantially vertically downward from the bottom surface 36B of both halves 36H. The tines 38 of one half 36H are offset from the tines 38 of the second half 36H. Each tine 38 is set at a slight angle, thereby enabling said tines 38 to cut grooves into the mixture contained within the hopper 16 during rotation of the mixing blade 32. As the mixing blade 32 rotates, the tines 38 of the second half 36H cut grooves into the mixture between the grooves cut by the tines 38 of the arm's first half 36H, thereby allowing water to infiltrate the mixture within the hopper 16. The length of the arm 36 is slightly shorter than the hopper diameter in order to allow said arm 36 to rotate within the hopper 16 without interference from the hopper inside wall 16B. The tines 38 extend downward toward the hopper bottom surface 16C, thereby allowing the contents of the hopper 16 to be thoroughly combined therein.

Figure 2:
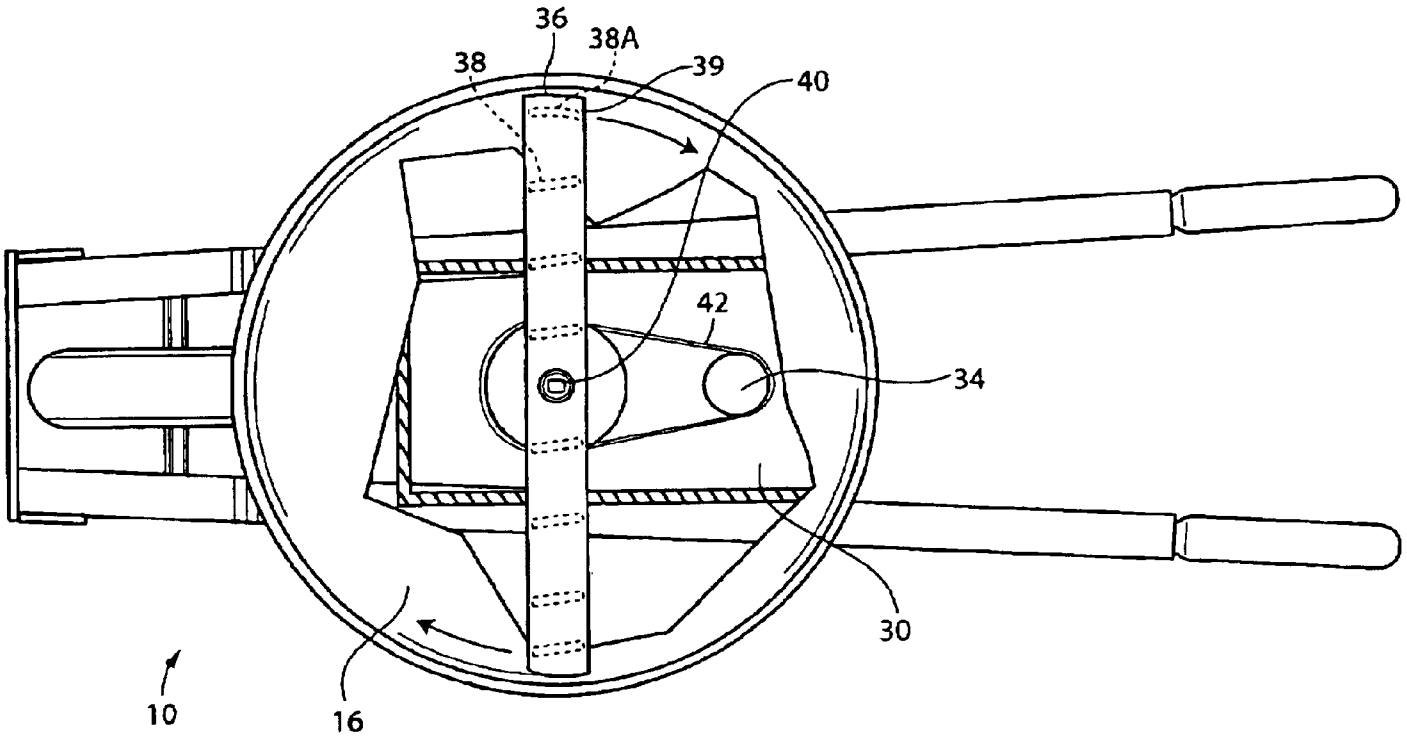
FIG. 2 is a top elevational view with parts broken away of the wheelbarrow with mixing assembly, having a portion of the hopper and motor assembly partially removed to illustrate the motor.

The tines 38 are substantially rectangular and generally slab or sheet-like, and are angled between extending transverse with the horizontal arm 36 and longitudinal with the horizontal arm. Such an arrangement facilitates cutting grooves in the mixture and resists cavitation. In addition, an outermost scraping tine 38A is included among the tines 38, and is positioned and shaped to scrape the hopper inside wall 16B as the mixing blade 32 rotates to prevent unmixed aggregate from adhering to the hopper inside wall 16B. The scraping tine 38A also has a leading edge 39. In particular, in the bowl shaped hopper 16 illustrated in FIG. 1, the outermost scraping tine 38A is convex and angled significantly towards the tine leading edge 39, compared to the other tines, which are positioned at an approximately 10 degree angle from square to the mixing arm. The outermost scraping tine 38A is angled toward the hopper inside wall 16B in the direction of rotation, as indicated in FIG. 2. This positioning allows the scraping tine 38A to scrape along the inside wall 16B of the hopper 16 without creating a wedge between said tine 38A and said hopper inside wall 16B. A shaft 40 extends from the horizontal arm 36 centrally through the bottom surface 16C of the hopper 16 into the motor housing 30, at which point said shaft 40 is mechanically linked with the motor 34. In this regard, a chain 42 preferably extends around the shaft 40 and the motor 34, thereby providing a linkage, which prompts rotation of the shaft 40 when the motor 34 is in operation. Rotation of the shaft 40 causes the horizontal arm 36 to rotate around the hopper 16 to effect mixing of the concrete, cement, mortar, or the like in the manner previously described.

In order to utilize the wheelbarrow with mixing assembly as a standard wheelbarrow, the mixing assembly may be removed from said wheelbarrow by lifting the assembly out of the shaft.

In conclusion, herein is presented a wheelbarrow with a mixing assembly for thoroughly mixing ingredients contained within the wheelbarrow hopper. The invention is illustrated by example in the drawing figures, and throughout the written description. It should be understood that numerous variations are possible, while adhering to the inventive concept. Such variations are contemplated as being a part of the present invention.

What is claimed is:

1. A wheelbarrow with a mixing assembly for mixing aggregate building products, comprising:

a wheelbarrow, the wheelbarrow having a base assembly and an open hopper mounted on said base assembly, the base assembly having a pair of horizontal supports, each support having a top surface, and a pair of legs extends vertically downward from each support, wherein the hopper is bowl shaped having a hopper diameter and a hopper inside wall, the hopper having an outer surface, an inner surface, and a bottom surface, wherein the bottom surface of the hopper is secured to the top surface of the horizontal supports; and a mixing assembly, the mixing assembly having a mixing blade, a motor, and a shaft extending between the mixing blade and the motor, wherein the mixing blade is positioned horizontally within the hopper for rotational movement therein about a vertical axis, the motor is positioned between the base assembly legs under the hopper, wherein the mixing blade comprises a horizontal arm having a bottom surface and having two halves, each of said halves having a plurality of substantially rectangular tines extending vertically downward from the bottom surface of the horizontal arm toward the bottom surface of the hopper, wherein the tines of the first half are offset from the tines of the second half, wherein each tine is set at a slight angle, thereby enabling said tines to cut grooves into the mixture contained within the hopper during rotation, in order that as the mixing blade rotates, the tines of the second half cut grooves into the mixture between the grooves cut by the tines of the arm's first half, thereby allowing water to infiltrate the mixture within the hopper, and wherein the arm has a length slightly shorter than the hopper diameter so as to allow the mixing blade to freely rotate within the hopper.

2. The wheelbarrow with mixing assembly as recited in claim 1, wherein the tines include an outermost scraping tine which is attached to the horizontal arm and extends downward therefrom but is mounted in close proximity to the hopper inner surface and shaped to conform to the hopper inside wall to prevent unmixed aggregate from adhering to the hopper inside wall during mixing.

3. The wheelbarrow with mixing assembly as recited in claim 2, wherein the outermost scraping tine has a leading edge, said scraping tine being convex and angled towards the tine leading edge.

4. The wheelbarrow with mixing assembly as recited in claim 3, wherein the tines are angled between extending transverse with the horizontal arm and longitudinal with the horizontal arm, in order to facilitate cutting grooves in the mixture.

5. The wheelbarrow with mixing assembly as recited in claim 4, further comprising a motor housing in which the motor is housed, the housing positioned between the base assembly legs under the hopper, said housing protecting the motor from damage.

6. The wheelbarrow with mixing assembly as recited in claim 5, wherein the motor has a chain linking the motor to the shaft, said chain producing rotational movement of the shaft, thereby causing the mixing blade to rotate within the hopper.

7. The wheelbarrow with mixing assembly as recited in claim 6, wherein the shaft extends vertically downward from the horizontal arm bottom surface through the hopper bottom surface into the motor housing.

8. The wheelbarrow with mixing assembly as recited in claim 7, wherein the wheelbarrow further comprises a plurality of braces, the braces each extending from one of the horizontal support top surfaces to the hopper outer surface, said braces securing the hopper to the base assembly of the wheelbarrow.

* * * * *